US010876404B2

(12) United States Patent
Gimpel et al.

(10) Patent No.: US 10,876,404 B2
(45) Date of Patent: Dec. 29, 2020

(54) ROLLER CUTTER UNIT FOR UNDERCUTTING MACHINE

(71) Applicant: SANDVIK INTELLECTUAL PROPERTY AB, Sandviken (SE)

(72) Inventors: Martin Gimpel, Leoben (AT); Guenther Staber, Murau (AT); Wolfgang Richter, Obdach (AT); Hubert Kargl, Gaal (AT); Gerald Kribitz, Kobenz (AT); Thomas Bumberger, Leoben (AT)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 16/347,564

(22) PCT Filed: Nov. 10, 2016

(86) PCT No.: PCT/EP2016/077279
§ 371 (c)(1),
(2) Date: May 3, 2019

(87) PCT Pub. No.: WO2018/086694
PCT Pub. Date: May 17, 2018

(65) Prior Publication Data

US 2019/0345823 A1 Nov. 14, 2019

(51) Int. Cl.

| | |
|---|---|
| ***E21D 9/10*** | (2006.01) |
| ***E21C 25/16*** | (2006.01) |
| ***E21C 31/02*** | (2006.01) |

(52) U.S. Cl.
CPC ..... *E21D 9/104* (2013.01); *E21C 25/16* (2013.01); *E21C 31/02* (2013.01); *E21D 9/10* (2013.01); *E21D 9/102* (2013.01)

(58) Field of Classification Search
CPC ..... E21C 27/22; E21D 9/104; E21D 9/1046; E21D 9/1006; E21D 9/1013; E21D 9/102; E21D 9/1026; E21D 9/1033
See application file for complete search history.

(56) References Cited

U.S. PATENT DOCUMENTS 4,108,259 A * 8/1978 Dixon ..... E21B 7/28 175/344
2002/0093239 A1* 7/2002 Sugden ..... E21D 9/1046 299/71

(Continued)

FOREIGN PATENT DOCUMENTS

AU 18912 2/1972
AU 2011200183 B2 8/2012

(Continued)

*Primary Examiner* — Janine M Kreck
*Assistant Examiner* — Michael A Goodwin
(74) *Attorney, Agent, or Firm* — Corinne R. Gorski

(57) ABSTRACT

A roller cutter unit is mountable at a cutting head of undercutting mining machines. The cutter unit includes an elongate mount shaft to position and support a cutter ring. The cutter ring is secured to the mount shaft via a bracket having a wedge segment configured to be wedged axially and radially between the cutter ring and the shaft. Accordingly, a mounting mechanism is provided to achieve a desired force transmission pathway from the cutter ring into the shaft so as to maximize the locking action of the cutter ring at the cutter unit.

17 Claims, 10 Drawing Sheets

(56) References Cited

U.S. PATENT DOCUMENTS

| | | | | |
|---|---|---|---|---|
| 2003/0230925 | A1* | 12/2003 | Oishi | E21D 9/1013 299/87.1 |
| 2007/0090678 | A1 | 4/2007 | Peach et al. | |
| 2010/0219676 | A1* | 9/2010 | Bechem | E21C 27/32 299/106 |

FOREIGN PATENT DOCUMENTS

| | | | |
|---|---|---|---|
| CN | 204061586 | * | 12/2014 |
| RU | 2059069 | C1 * | 4/1996 |
| WO | 00/46486 | A1 | 8/2000 |
| WO | 03/089762 | A1 | 10/2003 |
| WO | 03/106814 | A1 | 12/2003 |
| WO | 2009/036781 | A1 | 3/2009 |
| WO | 2016055087 | A1 | 4/2016 |

* cited by examiner

ROLLER CUTTER UNIT FOR UNDERCUTTING MACHINE

RELATED APPLICATION DATA

This application is a § 371 National Stage Application of PCT International Application No. PCT/EP2016/077279 filed Nov. 10, 2016.

FIELD OF INVENTION

The present invention relates to a roller cutter unit mountable at a cutting head of an undercutting mining machine and in particular, although not exclusively, to a cutter unit in which a cutter ring is releasably secured radially and axially at a shaft of the unit via a wedge segment of a mounting bracket.

BACKGROUND ART

A variety of different types of mining machines have been developed for the many different applications of rock cutting in a mine environment such as cutting drifts, tunnels, subterranean roadways and the like. Undercutting machines are typically suitable for cutting hard rock having a strength beyond 120 MPa. The machines utilise an undercutting principle in which rotatable cutters are forced and dragged against the rock to create a groove that facilitates overcoming the rock tensile strength.

Typically, an undercutting machine comprises a set of roller cutters mounted at a cutting head that may be raised upward in the undercutting mode. Each roller cutter comprises a cutter ring rotatably mounted at a support shaft that is capable of rotation about its central axis. The cutter rings are wear parts and require interchange at regular intervals as they become worn under the aggressive contact with the hard rock. Various mechanisms for mounting cutter rings at the cutter units have been proposed and examples are described in WO 03/089762; WO 03/106814 and WO 2009/036781.

However, existing mounting arrangements are disadvantageous for a number of reasons. In particular, the force transmission pathways of existing designs are not optimised and typically involve transmission through mounting bolts that are used to couple the cutter ring to the shaft. The cutter rings are subject to significant forces and stress during use and these are translated through the bolts it is common for the bolts to fail or the attachment of the ring to loosen. Additionally, some existing mountings, an attempt to provide a secure fixing, are overly complex. As such, it is typically time and labour intensive to interchange worn cutter rings with one machine typically carrying 24 roller cutter units. Accordingly, the overall machine performance and efficiency is reduced. As such, what is required is a mounting mechanism to provide a reliable and robust attachment of cutter rings in addition to their rapid mounting and interchange at the undercutting machine.

SUMMARY OF THE INVENTION

It is an objective of the present invention to provide a reliable and robust mechanism for releasably mounting a cutter ring at a cutting unit of an undercutting mining machine configured to withstand significant loading forces transmitted through the mounting mechanism during cutting. It is a further objective to provide a mounting mechanism that is relatively simple in construction and comprises a minimum number of component parts so as to allow rapid interchange of cutter rings when worn.

The objectives are achieved by providing a reliable undercutting disc ring attachment system having a wedge segment specifically adapted to provide a radial and axial lock of a cutter ring at a radially inner shaft to which the ring is releasably mounted. The wedge segment is advantageous to provide secure frictional contact between the ring and the shaft and to act as a force transmission conduit directly between the ring and the mounting shaft. In particular, the wedge segment specifically avoids undesirable direct transmission of loading forces through auxiliary mounting regions or attachments such as bolts or screws.

The present cutter ring attachment system may be formed as a single piece body including the wedge segment that may be conveniently mounted at and detached from a mounting position radially between a region of the shaft and the cutter ring. The present single piece body is adapted so as to retain the wedge segment in fixed and locked position radially between the cutter ring and the shaft via a set of mounting bolts or screws. Such bolts or screws provide positional fixing and stabilisation of the wedge segment only. That is, via the configuration of at least one of the cutter ring, the wedge segment and the shaft, transmission of loading forces through the bolts or screws is minimised or avoided.

According to a first aspect of the present invention there is provide a roller cutter unit mountable at a cutting head of an undercutting mining machine, the unit comprising; a shaft having a longitudinal axis and a mount region positioned at or towards a forward end of the shaft, the mount region having a radially outward facing mount face; a cutter ring having a radially outer cutting region and a radially inward facing lock face positionable opposed to the mount face; at least a section of the lock face and/or the mount face extending oblique to the axis; a mount bracket attachable to the shaft to releasably mount the cutter ring at the cutter unit; characterised in that: the bracket comprises a wedge segment having a first radially outward and a second radially inward facing contact face extending axially opposed to one another for abutment with the respective opposed lock face and mount face, the first and/or second face extending oblique to the axis to extend complimentary to the lock face and/or the mount face; wherein the wedge segment is configured to be wedged radially between the cutter ring and the mount region to releasably lock the cutter ring at the cutter unit.

Optionally, the wedge segment may be completely annular, at least partially annular or non-annular. Where the wedge segment is partially annular, the wedge segment body may be divided by one or more slots so as to define one or a plurality of wedge segment sections extending in a circumferential direction. That is, the wedge segment may be a complete ring or may be a split-ring having multiple segments (in a circumferential direction). Preferably, the wedge segment comprises a plurality of slots, each slot extending axially and radially through the wedge segment that is at least partially divided in a circumferential direction to define wedge fingers. This is advantageous to configure the wedge segment with a degree of radial compression so as to achieve a strong frictional contact between the opposed faces of the wedge segment and the respective surfaces of the cutter ring and mount region of the shaft.

Preferably, the bracket and wedge segment are formed integrally. Optionally, regions of the bracket may be formed from a first material and the wedge segment may be formed from a second material having different respective harnesses and/or compression strengths. Such a configuration provides a bracket having optimised physical and mechanical properties to achieve the desired high friction locking contact against the cutter ring and shaft.

Optionally, the bracket may comprise a central boss and the wedge segment may be generally annular to extend peripherally around the central boss. Optionally, the bracket may comprise a flexible neck provided radially between the wedge segment and the central boss. Optionally, the flexible neck may comprise a thickness in an axial direction being less than an axial thickness of the boss. Alternatively, the flexible neck may not comprise a reduced axial thickness and may be formed by a region of the bracket that connects the wedge segment and central boss. The neck according to the subject invention is advantageous to provide elastic pre-tensioning and the required biasing force to urge the wedge segment into full frictional mated contact with the cutter ring and shaft.

Optionally, the wedge segment may comprise an axial length greater than an axial length of the central boss. Optionally, the wedge segment may comprise an axial length being approximately equal to an axial length of the central boss.

Optionally, the lock face and the first contact face extend oblique to the axis and the mount face and the second face extend generally parallel to the axis. Optionally, the lock face and the first contact face extend orthogonal to the axis and the mount face and the second face extend orthogonal to the axis. Optionally, the angle by which the first contact face and the lock face extend orthogonal to the axis is greater than that of the second face and the mount face (relative to the axis). Optionally, an angle by which the first face and the lock face extend relative to the axis may be in a range 5 to 20°, 8 to 18° or 10 to 15°. Optionally, an angle by which the second contact face and the mount face extend relative to the axis may be in a range 0 to 5°, 0 to 4° or 0.5 to 3°.

Preferably, at least one or a combination of the mount region, the cutter ring and the wedge segment are dimensioned such that an axial gap is provided at an axial rearward end face of the wedge segment and an axial forward facing abutment face of the main shaft from which the mount region extends axially forward. The axial gap is beneficial so as to provide a region into which the wedge segment may 'grow' axially when subjected to axial compression loading from the cutter ring. Accordingly, such loading increases the frictional lock of the wedge segment at its mounted position and avoids creating any undesirable axial shear forces between the wedge segment and the mount region that may otherwise encourage withdrawal of the wedge segment from its mounting position.

Preferably, the bracket and the wedge segment are formed as at least a part annular ring. According to such an embodiment, the wedge segment effectively forms the entire body of the bracket. Optionally, the unit may further comprise a plurality of mount bolts to extend through the mount bracket and into the shaft to force the wedge segment radially between the cutter ring and the mount region. As will be appreciated, the bracket according to the subject invention may be secured at the shaft via other attachment components such as pins, screw threads or other mechanical fixings.

Optionally, the wedge segment may comprise bores to receive the bolts. Alternatively, the central boss may comprise bores to receive the bolts. Where the wedge segment does not comprise bores to receive mount bolts, preferably the wedge segment radially between the first and second contact faces is devoid of any bores or cavities so as to be continuously solid radially between the first and second contact faces. Accordingly, the body of the wedge segment is optimised mechanically so as to maximise the compression strength of the bracket at this mounting region to increase the frictional contact between the bracket, the cutter ring and shaft. Such an arrangement is advantageous to avoid undesirable loosening of the cutter ring when exposed to loading forces during cutting.

According to a second aspect of the present invention there is provided a cutting head of an undercutting mining machine comprising a plurality of cutter units according to the appended claims.

According to a third aspect of the present invention there is provided a mining machine comprising at least one cutting head as claimed herein, the at least one cutting head mounting a plurality of the cutter units.

Optionally, the at least one cutting head is mounted at an arm attached to the mining machine via a respective actuator to provide pivoting movement of the arm. Optionally, the mining machine may comprise two or a plurality of cutting heads, each head mounted at a respective arm and capable of independent pivoting movement relative to one another.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
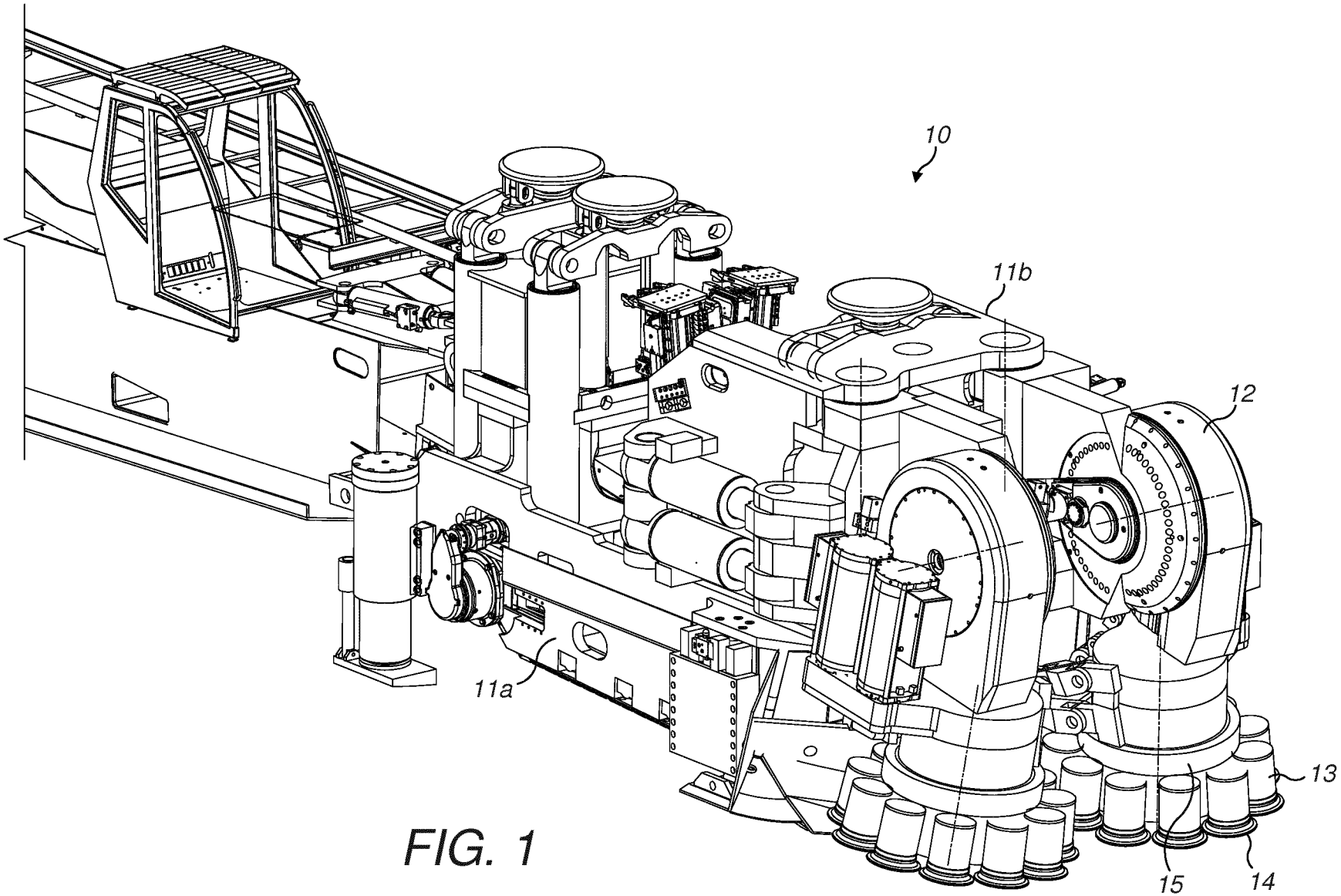
FIG. 1 is a perspective view of a mobile cutting apparatus suitable for creating tunnels or subterranean roadways having a forward mounted cutting heads each mounting a set of roller cutter units according to a specific implementation of the present invention.

Referring to FIG. 1, cutting apparatus 10 is configured to cut into rock within a mining environment to create drifts, subterranean roadways and the like so as to form an underground mine network. Apparatus 10 is configured for operation in an undercutting mode in which a plurality of rotatable roller cutter units 13 may be forced into the rock to create a groove or channel and then to be pivoted vertically upward so as to overcome the reduced tensile force immediately above the channel and break the rock. Accordingly, the cutting apparatus 10 is optimised for forward advancement into the rock using less force and energy typically required for conventional compression type cutters that utilise cutting bits or picks mounted at rotatable heads.

Apparatus 10 comprises a main frame 11*a* (or chassis) that mounts a sled 11*b* capable of sliding forward and aft along a forward region of the chassis 11*a*. A pair of pivoting arms 12 are mounted at a forward region of sled 11*b* and are configured to pivot independently via a generally horizontal pivot axis and a generally vertical pivot axis. A respective cutting head 15 is mounted at the distal end of each arm 12 and by rotation about the respective horizontal and vertical pivot axes is capable of being raised in a vertical plane (up and down) and slewing laterally in a horizontal plane (side-to-side). Each cutting head 15 mounts a plurality of cutter units 13, with each unit 13 rotatably mounting a respective cutter ring 14 (otherwise referred to as a roller cutter). As will be appreciated, apparatus 10 further comprises additional components associated with conventional undercutting apparatus including in particular an electric motor, jacking legs, tracks etc.

Referring to FIGS. 2 to 5, each cutter unit 13 comprises a main housing body 43 that provides a base for attachment of the unit 13 to the cutting head 15 via attachment bolts (not shown) that extend through a region of housing body 43. Housing body 43 mounts internally a rotatable shaft 22 that is rotatable about axis 21 extending centrally and longitudinally through cutter unit 13. Housing body 43 further comprises a set of internal bearings (not shown) to positionally support shaft 22.

Figure 2:
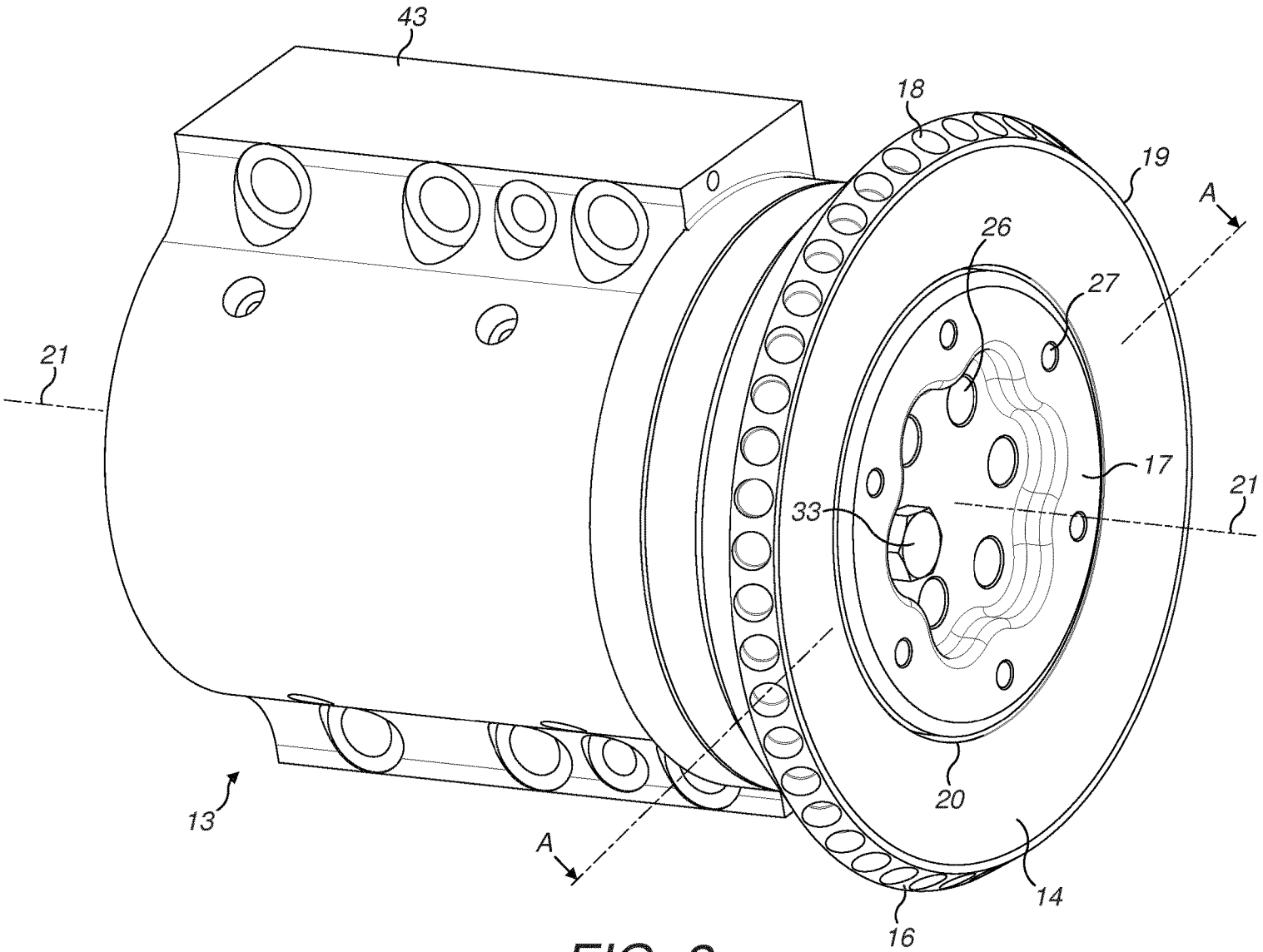
FIG. 2 is a perspective view of a cutting unit mountable at one of the cutting heads of the apparatus of FIG. 1 according to a first embodiment.
Figure 3:
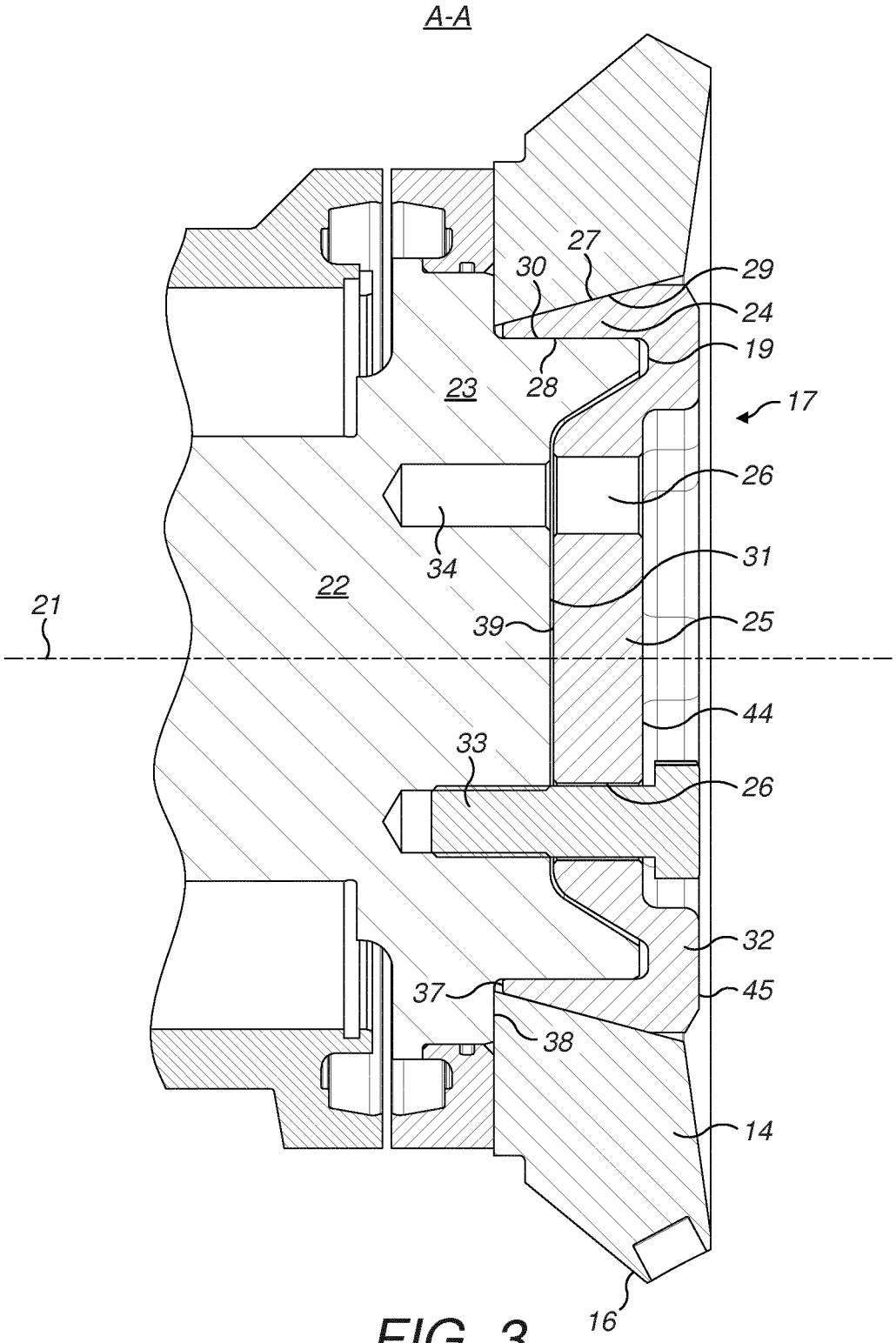
FIG. 3 is a cross sectional view through A-A of the cutting unit of FIG. 2.

With the cutter unit orientated as illustrated in FIG. 2, the cutter ring 14 represents a forwardmost component of the unit 13 with the housing body 43 representing a rearwardmost component. Cutter ring 14 comprises a radially outer perimeter region 16 to mount a plurality of hardened cutting teeth (not shown) within a respective set of mount recesses 18. Shaft 22 comprises an axially forward mount region 23 configured to positionally support cutter ring 14 at its forward mounted position via a radially inner region 20 of cutter ring 14. Mount region 23 according to the specific implementation, is formed as a radially raised annular rim (or flange) that projects axially forward from a forward facing front face 31 of shaft 22 such that shaft front face 31 is recessed axially relative to a forward facing annular end face 19 of mount region 23. An annular mount face 30 is orientated to be radially outward facing at mount region 23 and extends axially rearward from annular end face 19. Mount face 30 is terminated at its axial rearward end by an axially forward facing annular abutment face 38 formed by a part of shaft 22. Both the abutment face 38 and the generally circular shaft front face 31 are aligned generally perpendicular to axis 21 whilst mount surface 30 is aligned generally parallel to axis 21. A set of boreholes 34 project axially into shaft 22 from shaft front face 31 and are spaced apart in a circumferential direction (around axis 21) radially inward of mount region 23.

Shaft mount region 23 provides an indirect mounting of the annular cutter ring 14. Direct mounting of cutter ring 14 is achieved by a mount bracket illustrated generally by reference 17. Bracket 17 comprises a generally disc-like central boss 25. Central boss 25 comprises a generally planar axially rearward facing rear face 39 and an axially forward facing front face 44. An annular wedge segment 24 extends peripherally around boss 25 and is connected to boss 25 via an intermediate annular neck 32 (providing a continuous radial linkage to boss 25). Wedge segment 24 extends over a greater axial distance than a corresponding axial thickness of boss 25. Accordingly, a forward facing front face 45 of wedge segment 24 is positioned axially forward of the boss front face 44 and an annular axially rearward facing end face 37 of wedge segment 24 is positioned axially rearward of boss rear face 39. At least a region of neck 32 comprises an axial thickness that is reduced relative to the axial thickness of boss 25. This provides a degree of flex to allow wedge segment 24 bend in the axial and radial direction relative to central boss 25. Central boss 25 further comprises a set of boreholes 26 coaligned with shaft boreholes 34. Bracket 17 is releasably mountable to shaft 22 via a plurality of attachment bolts 33 insertable within boreholes 26 and 34 and secured in position via cooperating threads as will be appreciated. Accordingly, with bolts 33 secured in position, boss rear face 39 is held in contact against shaft front face 31.

Wedge segment 24 comprises an annular radially outward facing first face 27 and an opposed and corresponding annular radially inward facing second face 28. First face 27 is aligned oblique to axis 21 whilst second face 28 is aligned approximately parallel to axis 21 so as to define the wedge shape profile of the wedge segment 24 between rearward end face 37 and front face 45. Accordingly, wedge segment 24 comprises a radially thickness that increases (uniformly) from its axially rearward end to its axially forward end.

Cutter ring 14 comprises a corresponding annular radially inward facing lock face 29 positionable generally opposed to the radially outward facing shaft mount face 30. Wedge segment 24 is configured to be wedged into position axially and radially between cutter ring 14 and mount region 23. Accordingly, wedge first face 27 is configured for close fitting frictional contact against cutter ring lock face 29 and wedge second face 28 is configured for close fitting frictional contact against mount face 30.

During assembly of cutter ring 14 at cutter unit 13, the ring 14 is first positioned over the shaft mount region 23. Bracket 17 is then moved into position and the opposed faces 31 and 29 forced against one another by insertion of attachment bolts 33 into boreholes 26 and 34. The mounting of the bolts 33 within boreholes 34 forces the annular wedge segment 24 into wedging contact radially between shaft mount region 23 and the cutter ring 14 via the biasing force of the neck 32. Due to the complementary orientation of the respective friction contact faces 27, 28, 29 and 30, the cutter ring 14 is positionally locked and mounted at shaft 22 via the bracket 17 and in particular the annular wedge segment 24. Wedge segment 24 is advantageous to transmit directly all loading forces imparted to cutter ring 14 into shaft 22 via mount region 23. In particular, as the cutter ring 14 is mounted exclusively at shaft 22 via the frictional locking action of wedge segment 24 all radial and axial forces are transmitted through the wedge segment 24 (via frictional contact faces 27, 28, 29 and 30) and into the mount region 23 so as to avoid or reduce as far as possible transmission of such forces directly between the cutter ring 14 and the shaft 22. Additionally, the present configuration of bracket 17 having peripheral wedge segment 24 is further advantageous to avoid transmission of loading forces through the attachment bolts 33. That is, bolts 33 are positioned radially inside of and separated from the wedge segment 24 so as to be effectively isolated from transmission of loading forces from the cutter ring 14.

As will be appreciated, during use, wedge segment 24 is susceptible to distortion and in particular radial compression and axial elongation. Accordingly, wedge segment 24 and the mount region 23 are dimensioned and configured generally so as to create a small annular axial gap between the wedge segment rearward end face 37 and forward facing abutment face 38 of shaft 22. Accordingly, wedge segment 24 is capable of 'growing' axially within the region radially intermediate cutter ring 14 and mount region 23. Additionally, flexible neck 32 is configured to allow the bracket 17 to flex between the boss 25 and wedge segment 24 to compensate for such axial growth. However, neck 32 is sufficiently robust so as to provide the axial bias force to urge and maintain wedge segment 24 in its locked position between cutter ring 14 and mount region 23.

Figure 4:
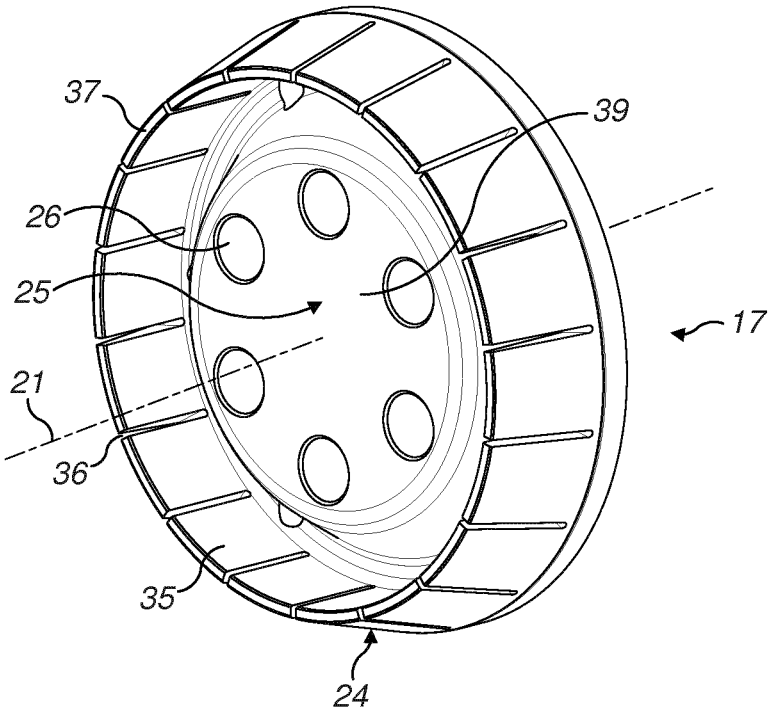
FIG. 4 is a rear perspective view of a bracket configured to secure a cutter ring to the unit of FIG. 3.
Figure 5:
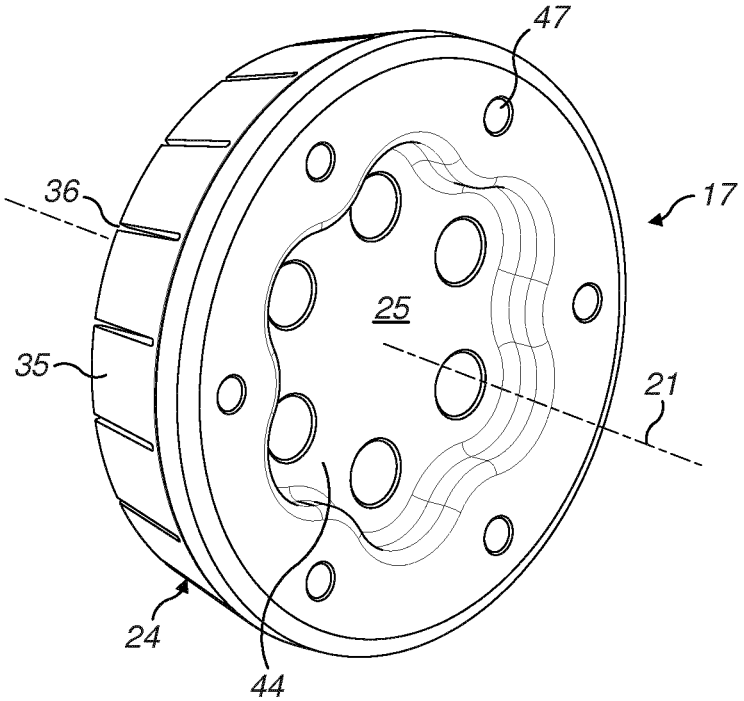
FIG. 5 is a front perspective view of the bracket of FIG. 4.
Figure 6:
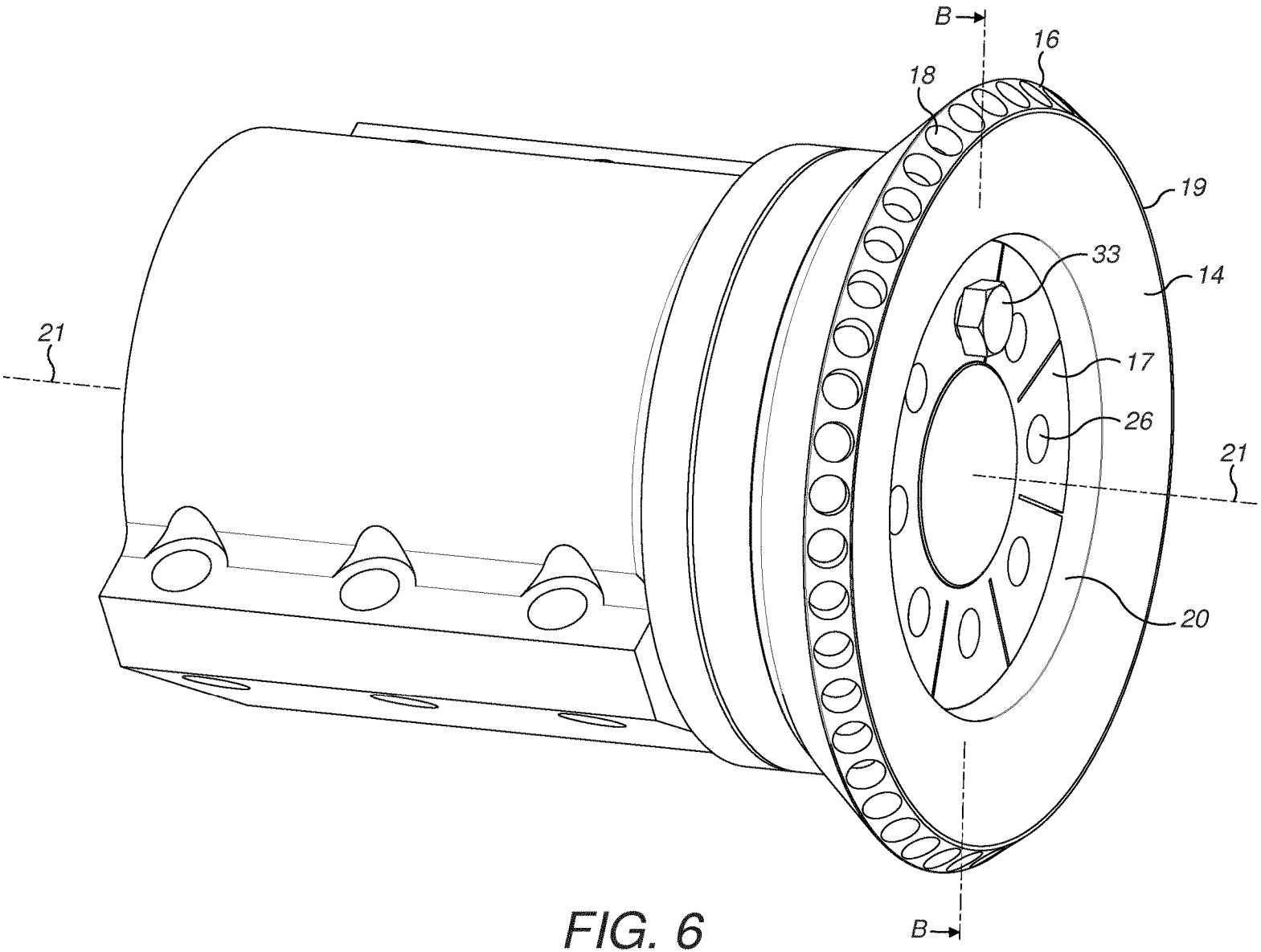
FIG. 6 is a perspective view of a cutter unit mountable at one of the cutting heads of the apparatus of FIG. 1 according to a second embodiment.
Figure 7:
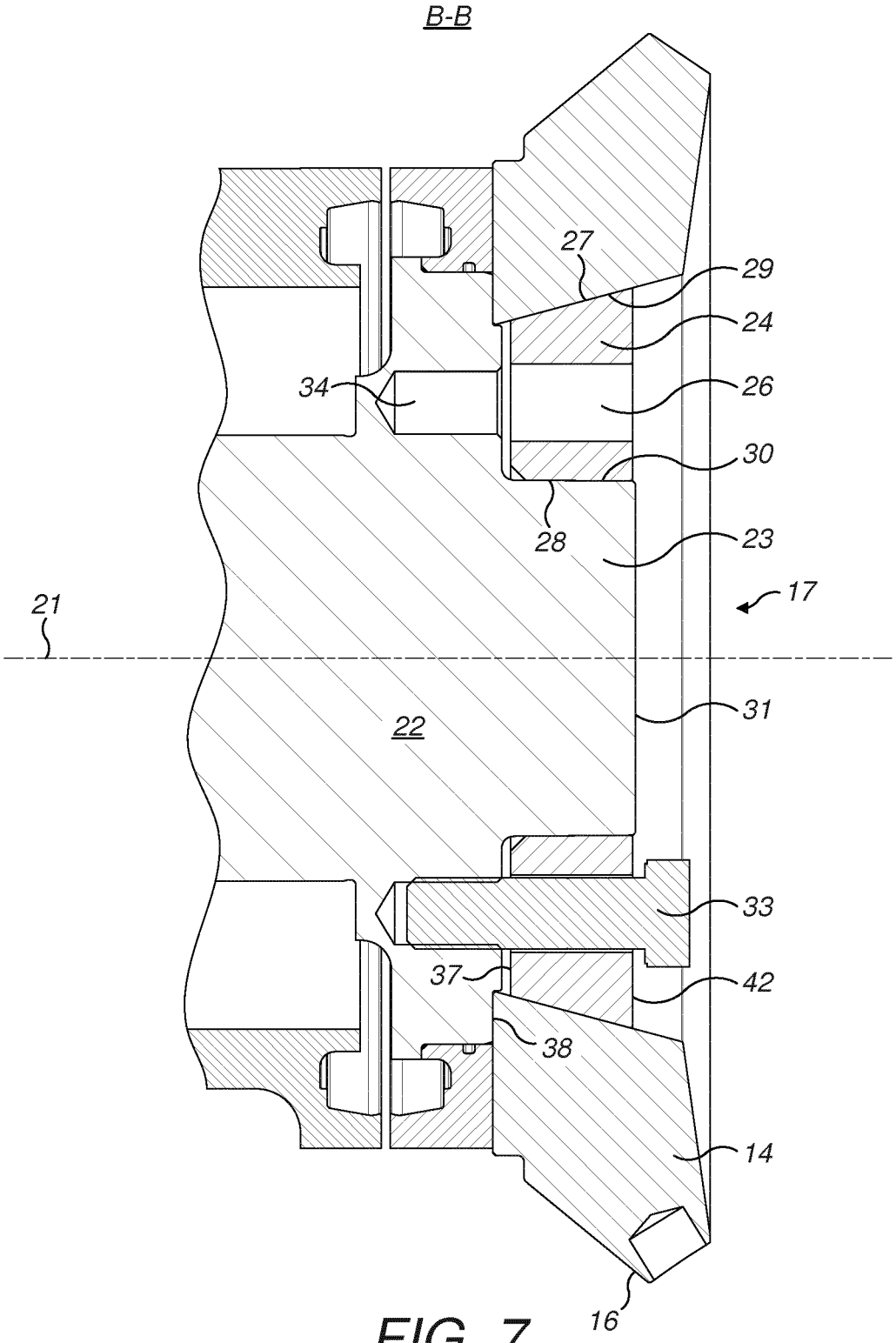
FIG. 7 is a cross sectional view through B-B of the cutter unit of FIG. 6.

Referring specifically to FIGS. 4 and 5, wedge segment 24 may be considered to be at least partially divided in a circumferential direction by a plurality of slots 36 that extend axially and radially through the wedge segment 24 between the first and second faces 27, 28 and the rearward end face 37 and front face 45. Accordingly, the wedge segment 24 may be considered to comprise a plurality of wedge fingers 35 distributed in a circumferential direction around axis 21. Fingers 35 enable wedge segment 24 to resiliently flex radially when compressed between the cutter ring 14 and shaft mount region 23.

Bracket 17 further comprises a secondary set of boreholes 47 positioned radially at the region of neck 32. Boreholes 47 are capable of receiving released bolts (via cooperating screw threads). Such bolts (not shown) are insertable through bracket 17 and against mount region end face 19. This configuration provides a means of forcing withdrawal of the wedge segment 24 from between the cutter ring 14 and mount region 23. Naturally, attachment bolt 33 would be first removed from the borehole 34 prior to forced withdrawal of the wedge segment 24 (via the release bolts).

A second embodiment of the cutter unit 13 is described with reference to FIGS. 6 to 9 and a third embodiment is described with reference to FIGS. 10 to 13. The components and reference numbers of the various embodiments described herein are shared and consistent. However, as will be described, the shape, construction and configuration of the bracket 17 is different within each embodiment in addition to a shape and configuration of the shaft mount region 23.

According to the second embodiment of FIGS. 6 to 9, bracket 17 is formed as a generally annular wedge-shaped ring having axially rearward facing end face 37 and then opposed axially forward facing front face 42. Bracket 17 unlike the first embodiment (FIGS. 2 to 5) does not comprise a central boss. As such, bracket 17 is configured to completely overlap axially the axial end region of shaft 22 such that the bracket front face 42 is recessed axially relative to the shaft front face 31. According to the second embodiment, the wedge segment 24 defines the bracket 17 in which the radially outward and radially inward facing first and second faces 27 and 28 extend axially between the rearward end face 37 and front face 42. The set of boreholes 26 extend axially through wedge segment 24 radially between first and second faces 27, 28 and axially between rearward end face 37 and front face 42.

Shaft mount region 23, according to the second embodiment, is formed as a generally cylindrical axial end region of shaft 22. Additionally, the radially outward facing mount face 30 is aligned slightly oblique to axis 21 so as to taper radially outward in a direction from shaft front face 31 to shaft abutment face 38 (that extends perpendicular to axis 21). Accordingly, the radially inward facing first face 28 of wedge segment 24 is also aligned slightly oblique to axis 21. As described with reference to the first embodiment, the wedge segment first face 27 and the cutter ring lock face 29 are aligned oblique to axis 21 so as to be aligned oblique to the wedge segment second face 28 and mount face 30. Accordingly, for all embodiments described herein, the surface area of the wedge segment rearward end face 37 is less than a corresponding surface area of the wedge segment front face 42.

The angle by which the first face 27 extends relative to axis 21 is greater than that of the second face 28 such that a cross section of wedge segment 24 in an axial plane is not symmetrical. According to further variations of the second embodiment, the wedge segment second face 28 and mount face 30 may be aligned to extend generally parallel to axis 21.

As with the first embodiment, the wedge shaped ring of the second embodiment is configured to sit and to be wedged radially between the cutter ring 14 and mount region 23 so as to provide exclusively a means to secure the cutter ring 14 to the cutter unit 13. Accordingly, all axial and radial aligned forces are configured to be transmitted from the cutter ring 14 into the shaft 22 exclusively via the wedge segment 24 which is maintained in position via the attachment bolts 33 received within boreholes 34 and 26. As described, within the second embodiment, the attachment bolts 33 are positioned to extend through the wedge segment 24. Accordingly, it will be appreciated that a relatively small percentage of forces may be transmitted through the attachment bolts 33 from the cutter ring 14 to the shaft 22. However, the wedge segment 24, being maintained in a radially compressed and locked state between the cutter ring 14 and shaft 22, is suitable to transfer the majority (nearly all) of the loading forces. Importantly, no part of the cutter ring 14 extends axially in direct contact with the shaft 22 which would otherwise be detrimental to allow direct radial force transmission. As described previously a small axial gap is created between the wedge segment rearward end face 37 and the shaft abutment face 38 so as to allow some degree of axial growth of the wedge segment 24 when compressed in use. Accordingly, the wedge segment 24 is prevented from 'bottoming' at the region radially between the cutter ring 14 and the mount region 23 which may otherwise reduce the friction locking action of the bracket 17 and provide undesired transmission of loading force through the attachment bolts 33.

Figure 8:
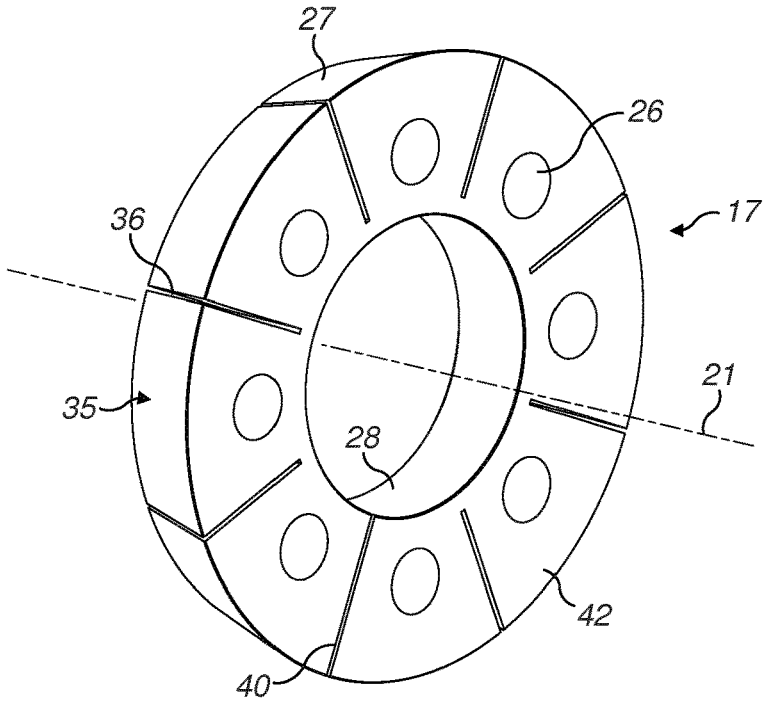
FIG. 8 is a front perspective view of a bracket configured to secure a cutter ring to the unit of FIG. 6.
Figure 9:
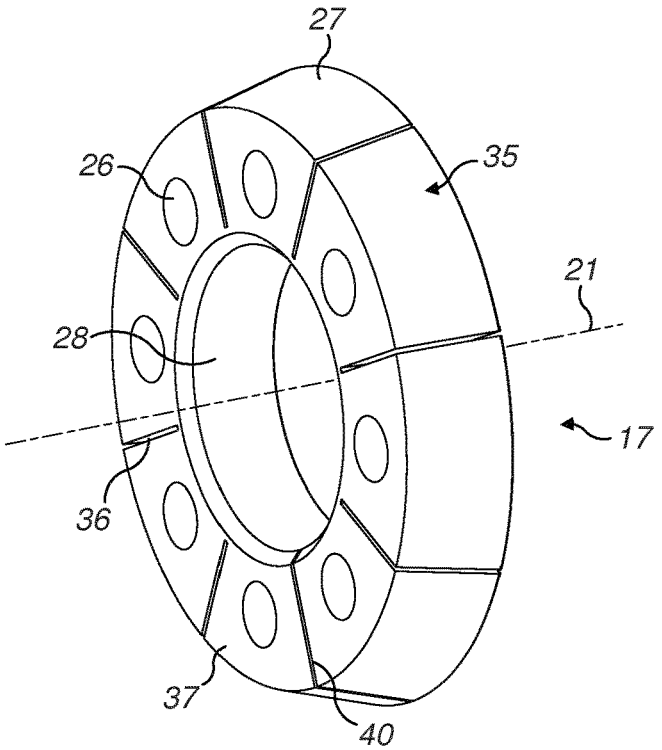
FIG. 9 is a rear perspective view of the bracket of FIG. 8.
Figure 10:
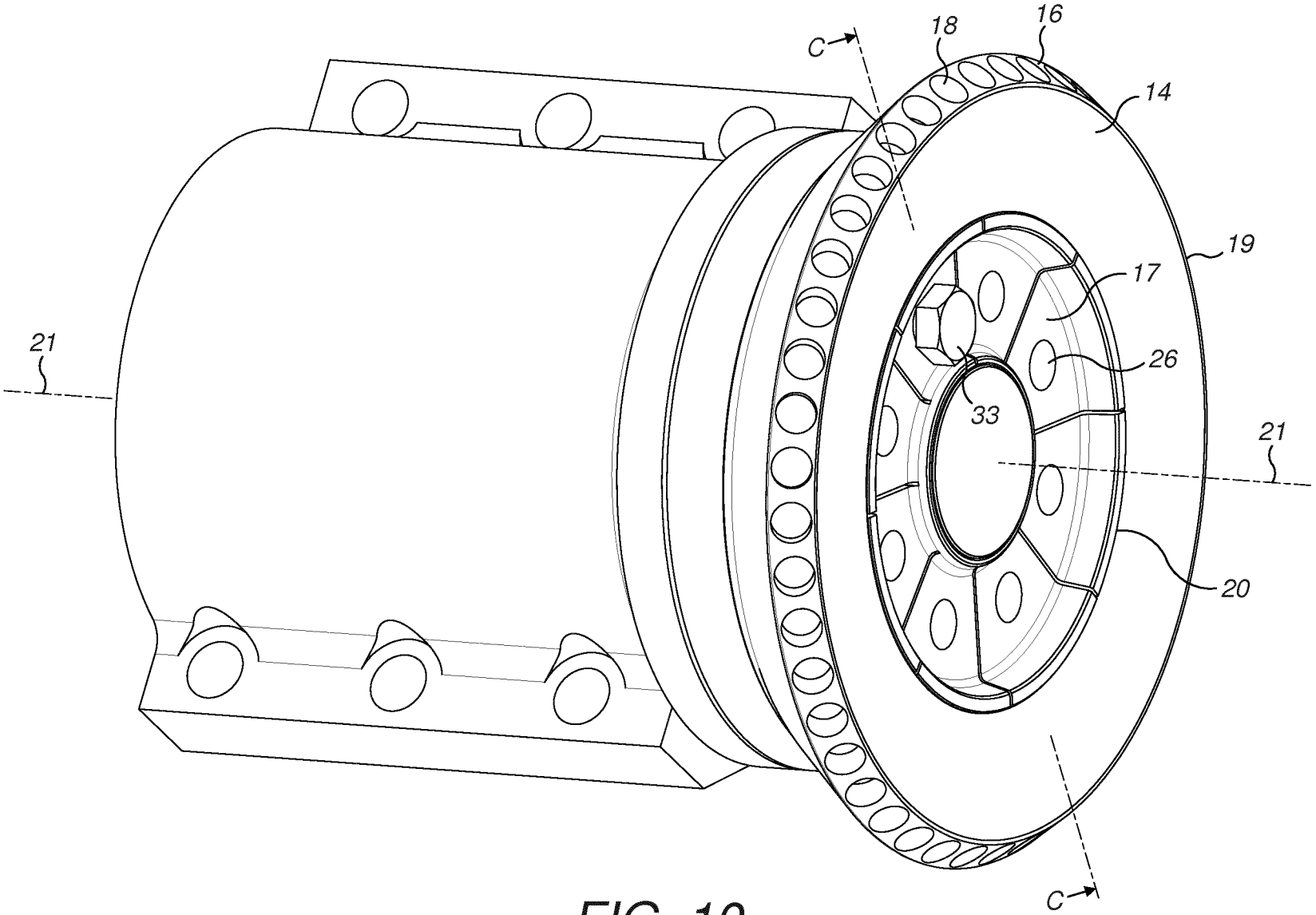
FIG. 10 is a perspective view of a cutter unit mountable at one of the cutting heads of the apparatus of FIG. 1 according to a third embodiment.
Figure 11:
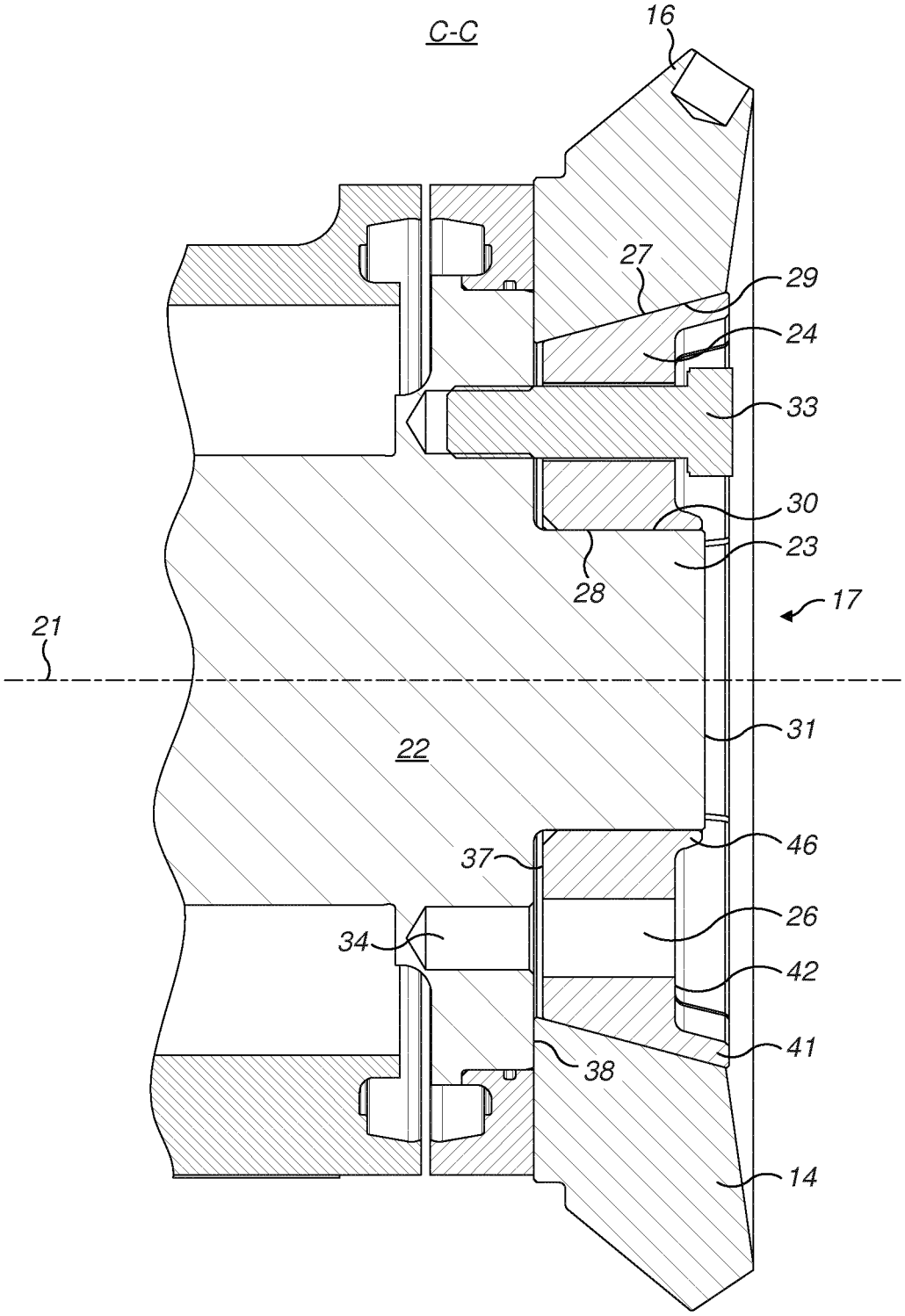
FIG. 11 is a sectional view through C-C of the cutter unit of FIG. 10.
Figure 12:
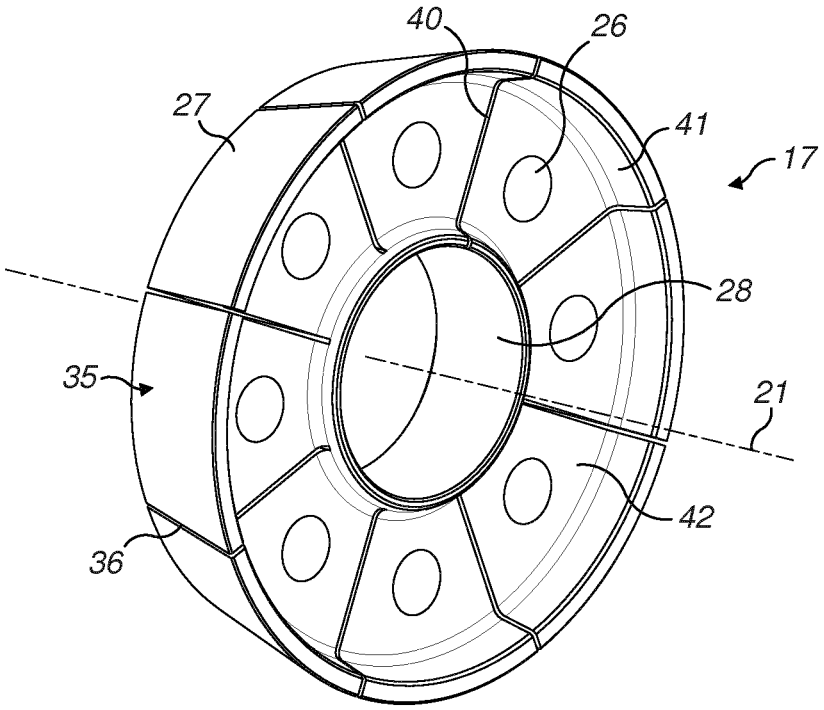
FIG. 12 is a front perspective view of a bracket configured to secure a cutter ring to the unit of FIG. 10.
Figure 13:
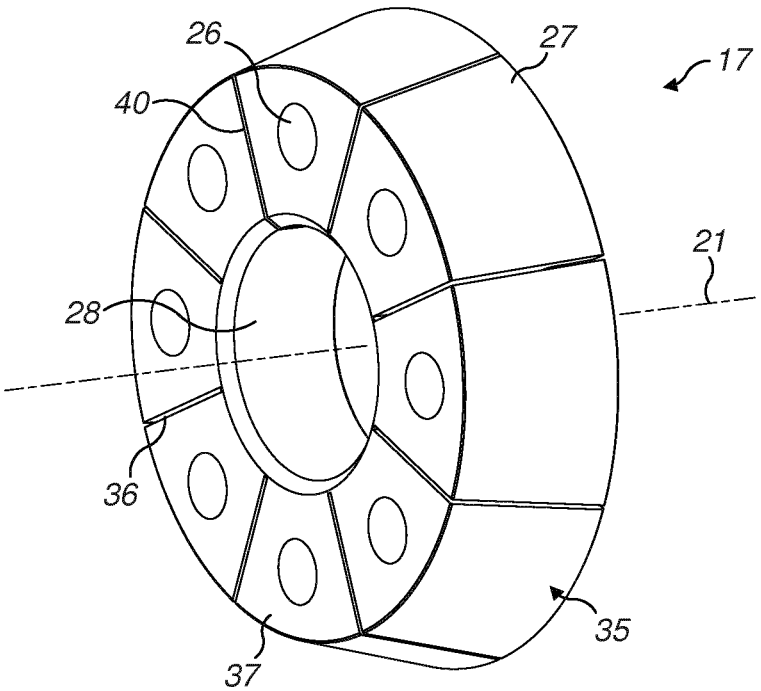
FIG. 13 is a rear perspective view of the bracket of FIG. 12.

Referring to FIGS. 8 and 9, wedge segment 24 is formed as a split-ring in which a single slot 40 extends completely axially and radially through the wedge segment 24 between the respective faces 27, 28, 37 and 42. Additionally, a plurality of partial slots extend axially and radially through wedge segment 24. In particular, partial slots 36 extend radially from the first face 27 towards but not completely through to the radially inward facing second face 28. The partial slots 36 and complete slot 40 define wedge fingers 35, that are capable of compressing together radially and in a circumferential direction as the bracket 17 is clamped against shaft 22 via attachment bolts 33 as described referring to the first embodiment. This compressive function provides for a secure axial and radial lock of the wedge segment 24 and a maximised frictional contact between the opposed pairs of faces 27, 29 and 28, 30.

A third embodiment of the present invention is described referring to FIGS. 10 to 13. The third embodiment corresponds to the second embodiment to FIGS. 6 to 9 and comprises generally the same components and configuration with the reference numbers and components being consistent. Bracket 17 according to the third embodiment differs slightly from the bracket 17 of the second embodiment. However, both brackets 17 comprise the same generally annular ring-shaped profile so as to allow the annular cutter ring 14 to be placed over and about the generally cylindrical shaft mount region 23 (representing an axially forwardmost end region of shaft 22). The first and second faces 27, 28 of the bracket 17 of the third embodiment are aligned as described with reference to the second embodiment so as to be oblique to axis 21 and generally transverse to one another so as to define the wedge segment having a thickness in a radial direction that increases from rearward end face 37 to the front face 42. According to both embodiments two and three, the angular orientation of the first face 27 is greater than that of the second face 28 (relative to axis 21). Such an arrangement is advantageous to provide a desired locking and frictional hold between the cutter ring 14 and the wedge segment 24 at the radially outer region of the bracket 17. Bracket 17 according to the third embodiment differs from that of the second embodiment via a first radially outer annular projection 41 that extends axially forward from the wedge segment front face 42. A second annular projection 46 projects from wedge segment front face 42 at its radially inner region. Projections 41 and 46 are positioned respectively at the outermost and innermost perimeters of bracket 17 and an axial length of inner projection 46 is less than that of the outer projection 41. However, both the inner and outer projections 41, 46 increase the axial length of the first and second face 27, 28 so as to increase the surface area contact between the wedge segment 24 and the cutter ring 14. Projections 41 and 46 are configured to deform radially inward as the wedge segment 24 is forced radially between the cutter ring 14 and the mount region 23 via attachment bolts 33 received within boreholes 34. Accordingly, the radial and axial lock of the wedge segment 24 and accordingly the cutter ring 14 is increased via the increased surface area contact provided by the projections 41, 46. As described previously, a small axial gap is maintained between the wedge segment rearward end face 37 and shaft abutment face 38 to avoid the wedge segment 'bottoming' against the shaft 22 which would otherwise decrease the locking effect of the bracket 17. The bracket 17, according to the third embodiment, comprises the same single complete slot 40 and partial slots 36 so as to be capable of compression in both the radial and circumferential directions as described.

To release the wedge segment 24 of the second and third embodiments, at least one specifically adapted release bolt (not shown) is inserted into boreholes 26 and 34. A first axial portion of the shaft of such bolts may be oversized relative to the bracket boreholes 26 and a second axial end portion of the bolts may be undersized relative to shaft boreholes 34. Accordingly, as the release bolts are forced into bracket 17 they are capable of bottoming against the terminal end of shaft boreholes 34 such that continued rotation draws the wedge segment 24 from its wedged and locked position against the cutter ring 14 and mount region 23.

According to the various embodiments, the angle by which the wedge segment first face 27 extends relative to axis 21 is in a range 10 to 15°. Additionally, the angle by which the wedge segment second face 28 extends relative to axis 21 is in a range 0 to 5°. And in particular 0.5 to 3°. Such a configuration is advantageous to provide a balance between achieving a sufficient radial and axial lock of the cutter ring 14 at the shaft 22 whilst allowing convenient mounting and dismounting of the bracket 17 to and from its locked position radially between the cutter ring 14 and the shaft 22.

The various embodiments of the subject invention are advantageous to maximise the strength by which the cutter ring 14 is locked radially and axially at the shaft 22. This locking action is achieved by the opposed radially outward facing and radially inward facing first and second faces 27, 28. When wedged in position between the cutter ring 14 and the mount region 23, loading forces are capable of being transmitted radially through the wedge segment 24 via the opposed first and second wedge faces 27, 28. Importantly, the first and second faces 27, 28 are aligned so as to be opposed radially (in radially opposite facing directions) and as such to be positioned at the same general axial position so as to overlap axially and define the main body of the wedge segment 24 in combination with the end face 37 and from face 45. That is, the first and second faces 27, 28 are not axially 'staggered' or 'axially off-set' that would otherwise prevent direct radial transmission of locking forces at the same corresponding axial position immediately and directly radially inside of the cutter ring 14. According to all embodiments described herein, the cutter ring does not comprise an axially extending portion that is positioned in direct contact with any region of the shaft 22. Accordingly, the complete axial length of the cutter ring 14 at its radially inner region is separated from the shaft 22 (mount region 23) by abutment contact with the wedge segment 24.

The subject invention is further advantageous to provide a mounting mechanism for a cutter ring 14 that enables the convenient and rapid interchange of worn cutter rings 14 via a two stage disassembly process as described. Mounting of a replacement cutter ring 14 may be achieved conveniently via simply attaching bracket 17 to the shaft front face 31 so as to insert the wedge segment 24 into its axially and radially locked position radially between the cutter ring 14 and the shaft mount region 23.

The invention claimed is:

1. A roller cutter unit mountable at a cutting head of an undercutting mining machine, the unit comprising:

a shaft having a longitudinal axis and a mount region positioned at or towards a forward end of the shaft, the mount region having a radially outward facing mount face;

a cutter ring having a radially outer cutting region and a radially inward facing lock face positionally opposed to the mount face, at least a section of the lock face and/or the mount face extending oblique to the axis; and a mount bracket attachable to the shaft to releasably mount the cutter ring at the cutter unit, wherein the bracket includes a wedge segment having a first radially outward facing contact face and a second radially inward facing contact face, the first radially outward facing contact face being arranged for abutment with the lock face and the second radially inward facing contact face abutting the mount face, the first and/or second contact face extending oblique to the axis to extend complimentary to the lock face and/or the mount face, wherein the wedge segment is configured to be wedged radially between the cutter ring and the mount region to releasably lock the cutter ring at the cutter unit.

2. The unit as claimed in claim 1, wherein the wedge segment includes a plurality of slots, each slot extending axially and radially through the wedge segment that is at least partially divided in a circumferential direction to define wedge fingers.

3. The unit as claimed in claim 1, wherein the bracket and wedge segment are formed integrally.

4. The unit as claimed in claim 1, wherein the bracket includes a central boss and the wedge segment is generally annular and extends peripherally around the central boss.

5. The unit as claimed in claim 4, further comprising a flexible neck provided radially between the wedge segment and the central boss.

6. The unit as claimed in claim 5, wherein the flexible neck includes a thickness in an axial direction that is less than an axial thickness of the boss.

7. The unit as claimed in claim 4, wherein the wedge segment includes an axial length that is greater than an axial length of the central boss.

8. The unit as claimed in claim 4, wherein the wedge segment disposed radially between the first and second contact faces is devoid of any bores or cavities so as to be continuously solid radially between the first and second contact faces.

9. The unit as claimed in claim 1, wherein the lock face and the first contact face extend oblique to the axis and the mount face and the second face extend parallel to the axis.

10. The unit as claimed in claim 1, wherein at least one or a combination of the mount region, the cutter ring and the wedge segment are dimensioned such that an axial gap is provided at a rearward end face of the wedge segment and a forward facing abutment face of the shaft from which the mount region extends axially forward.

11. The unit as claimed in claim 1, wherein the bracket and the wedge segment are formed as at least a part of an annular ring.

12. The unit as claimed in claim 1, further comprising a plurality of mount bolts arranged to extend through the mount bracket and into the shaft to force the wedge segment radially between the cutter ring and the mount region.

13. The unit as claimed in claim 12, wherein the wedge segment includes bores to receive the mount bolts.

14. The unit as claimed in claim 12, wherein the central boss includes bores to receive the mount bolts.

15. A cutting head of an undercutting mining machine comprising a plurality of cutter units according to claim 1.

16. A mining machine comprising at least one cutting head as claimed in claim 15, the at least one cutting head mounting a plurality of the cutter units.

17. The mining machine as claimed in claim 16, wherein the at least one cutting head is mounted at an arm attached to the mining machine via a respective actuator to provide pivoting movement of the arm.

* * * * *